US008429915B1

(12) United States Patent
Hadley et al.

(10) Patent No.: US 8,429,915 B1
(45) Date of Patent: Apr. 30, 2013

(54) INJECTOR HAVING MULTIPLE FUEL PEGS

(75) Inventors: Mark Allan Hadley, Greer, SC (US); David Kenton Felling, Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/274,826

(22) Filed: Oct. 17, 2011

(51) Int. Cl.
*F23R 3/14* (2006.01)
*F23R 3/283* (2006.01)
*F23R 3/286* (2006.01)

(52) U.S. Cl.
USPC ..... 60/748; 60/740; 60/742; 60/737

(58) Field of Classification Search ..... 60/733, 60/740, 742, 748, 737, 746, 747
See application file for complete search history.

(56) References Cited

U.S. PATENT DOCUMENTS 2,585,205 A * 2/1952 Young ..... 261/76
2,618,928 A * 11/1952 Nathan ..... 60/737
5,511,375 A * 4/1996 Joshi et al. ..... 60/39.463
5,749,219 A * 5/1998 DuBell ..... 60/804
5,826,429 A * 10/1998 Beebe et al. ..... 60/723
6,047,550 A 4/2000 Beebe
6,192,688 B1 2/2001 Beebe
6,442,939 B1 * 9/2002 Stuttaford et al. ..... 60/737
6,820,411 B2 * 11/2004 Pederson et al. ..... 60/229
6,868,676 B1 * 3/2005 Haynes ..... 60/776
7,665,309 B2 * 2/2010 Parker et al. ..... 60/776
2005/0126180 A1 * 6/2005 Chen et al. ..... 60/776
2006/0156734 A1 * 7/2006 Bland ..... 60/776

FOREIGN PATENT DOCUMENTS

WO 2009038652 A2 3/2009

* cited by examiner

*Primary Examiner* — William H Rodriguez
*Assistant Examiner* — Carlos A Rivera
(74) *Attorney, Agent, or Firm* — Cantor Colburn LLP

(57) ABSTRACT

A fuel injector is provided, including a fuel injector body, a plurality of fuel vanes, and a plurality of fuel pegs. The injector body includes a manifold and an inlet. The manifold is configured for receiving fuel, and the inlet is configured for receiving air. The fuel vanes are located within the injector body and are positioned in a direction that is generally parallel with a longitudinal axis of the injector body to orient the air flowing from the inlet. The plurality of fuel pegs are fluidly connected to the manifold and are arranged within the plurality of fuel vanes. The plurality of fuel pegs are each spaced at a distance that is about equal between each of the plurality of fuel pegs.

18 Claims, 5 Drawing Sheets

INJECTOR HAVING MULTIPLE FUEL PEGS

FEDERAL RESEARCH STATEMENT

This invention was made with Government support under contract number DE-FC26-05NT42643 awarded by the Department Of Energy. The Government has certain rights in this invention.

BACKGROUND OF THE INVENTION

The subject matter disclosed herein relates to a fuel injector, and particularly to a fuel injector having a plurality of fuel vanes and a plurality of fuel pegs arranged within the fuel vanes.

Gas turbines usually burn hydrocarbon fuels and produce air polluting emissions such as oxides of nitrogen (NOx) and carbon monoxide. Oxidization of molecular nitrogen in the gas turbine depends upon the temperature of gas located in a combustor, as well as the residence time for reactants located in the highest temperatures regions within the combustor. Thus, the amount of NOx produced by the gas turbine may be reduced by either maintaining the combustor temperature below a temperature at which NOx is produced, or by limiting the residence time of the reactant in the combustor.

One approach for controlling the temperature of the combustor involves premixing fuel and air to create a lean air-fuel mixture prior to combustion. This approach includes the development of fuel injection where the air-fuel mixture is injected into and mixed with a main flow of high energy fluid from the combustor. Specifically, the air-fuel mixture becomes entrained with the main flow of high energy fluid before ignition. This approach results in increasing the consumption of fuel, which in turn reduces the air polluting emissions.

BRIEF DESCRIPTION OF THE INVENTION

According to one aspect of the invention, a fuel injector is provided including a fuel injector body, a plurality of fuel vanes, and a plurality of fuel pegs. The injector body includes a manifold and an inlet. The manifold is configured for receiving fuel, and the inlet is configured for receiving air. The fuel vanes are located within the injector body and are positioned in a direction that is generally parallel with a longitudinal axis of the injector body to orient the air flowing from the inlet. The plurality of fuel pegs are fluidly connected to the manifold and are arranged within the plurality of fuel vanes. The plurality of fuel pegs are each spaced at a distance that is about equal between each of the plurality of fuel pegs.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
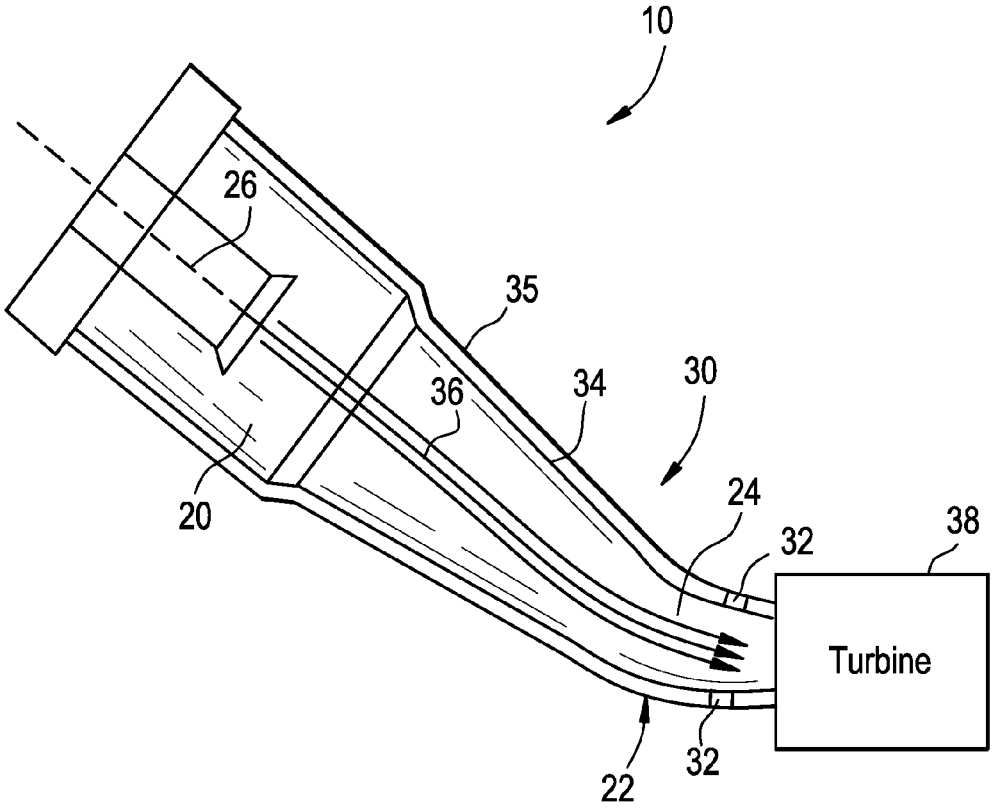
FIG. 1 is an exemplary schematic illustration of a combustor for a gas turbine.

FIG. 1 is an exemplary schematic illustration of a combustor 10 for a gas turbine engine (not shown). The combustor 10 includes a primary combustion section 20, a transition piece 22, and a secondary combustion section 24. The primary combustion section 20 includes at least one primary fuel injector 26. Disposed downstream of the primary combustion section 20 is the transition piece 22 and the secondary combustion section 24. In one embodiment, a secondary injection system 30 is typically disposed outside of the transition piece 22 and includes a plurality of secondary fuel injectors 32, however it is to be understood that the secondary injection system 30 could be located outside of a combustion liner 34 as well. For example, in the embodiment as shown in FIG. 1, the secondary fuel injectors 32 are placed between the combustion liner 34 and a flow sleeve 35. A primary combustion stream or main flow 36 is created by the combustion of air and fuel from primary fuel injector 26, which travels through the primary combustion section 20 to the secondary injection system 30. The air-fuel mixture (not shown) injected by the secondary fuel injectors 32 penetrates the oncoming main flow 36. The fuel supplied to the secondary fuel injectors 32 are combusted in the secondary combustion section 24 before entering a turbine section 38 of a gas turbine (not shown).

Figure 2:
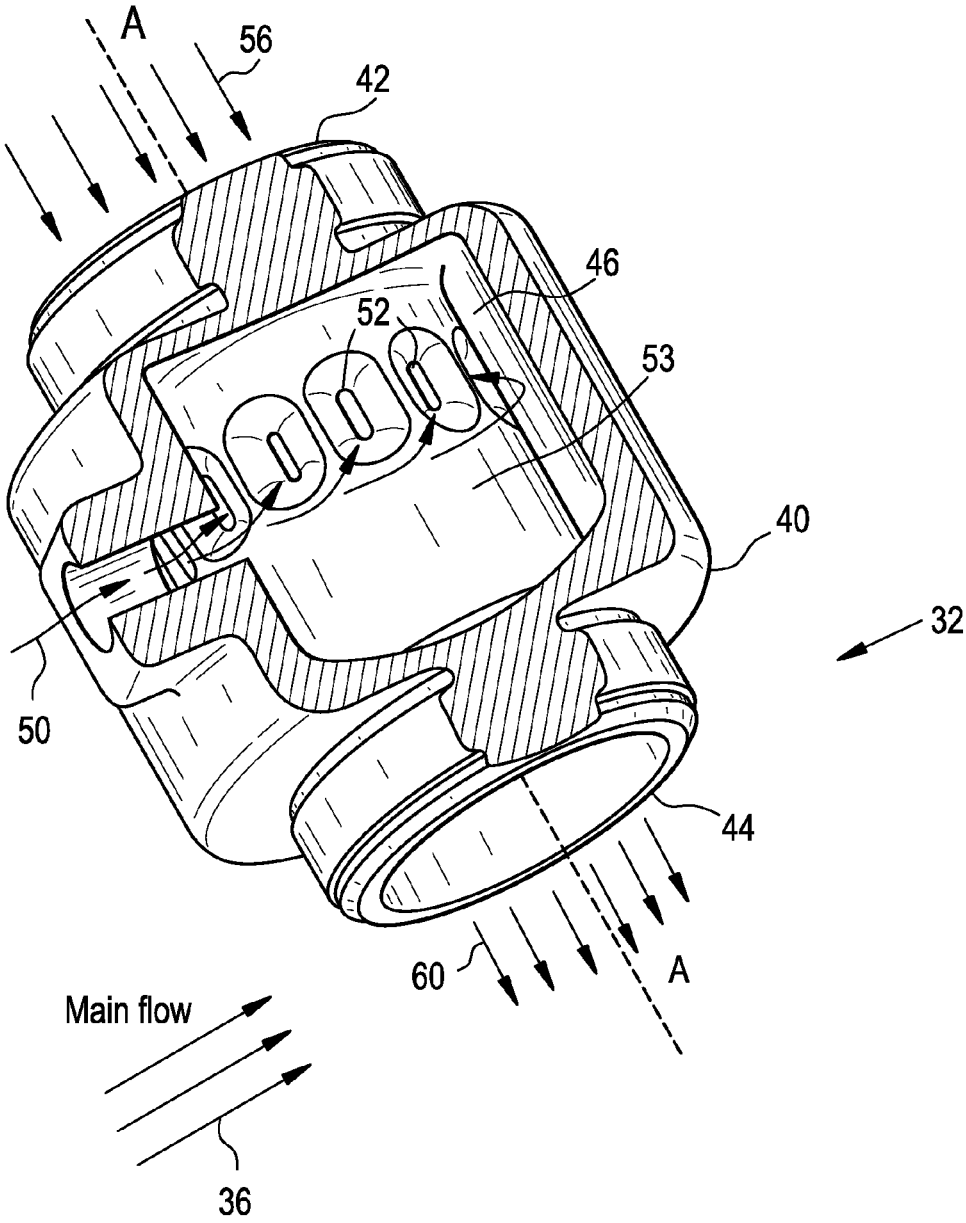
FIG. 2 is a cross-sectioned view of a fuel injector for the combustor shown in FIG. 1.

Turning now to FIG. 2, one of the secondary fuel injectors 32 of the secondary injection system 30 is shown in partial cross-section. The secondary fuel injector 32 includes a generally tubular injector body 40. The injector body 40 includes an inlet 42, an outlet 44, and a fuel distribution chamber or fuel manifold 46. The outlet 44 of the injector body may be fluidly connected to either the transition piece 22 or the combustion liner 34 (both are shown in FIG. 1). The manifold 46 receives fuel 50 through an aperture 48 that is defined by the injector body 40. The fuel 50 flows in the manifold 46 to a plurality of openings 52 that are located along an inner wall portion 53 of the fuel injector 32. The openings 52 fluidly connect the manifold 46 to a plurality of fuel pegs 54 (shown in FIG. 3) that are located within the injector body 40. The inlet 42 typically receives air 56 from a compressor (not shown), where the air 56 mixes with the fuel 50 to create an air-fuel mixture 60 that is discharged or exits the injector body 40 from the outlet 44. Specifically, a mixing zone 58 for air and fuel is defined from the fuel pegs 54 to the outlet 44. In the embodiment as illustrated, the air-fuel mixture 60 is oriented in a direction that is generally perpendicular to the main flow 36 created by the combustion of air and fuel from primary fuel injector 26 (shown in FIG. 1).

Figure 4:
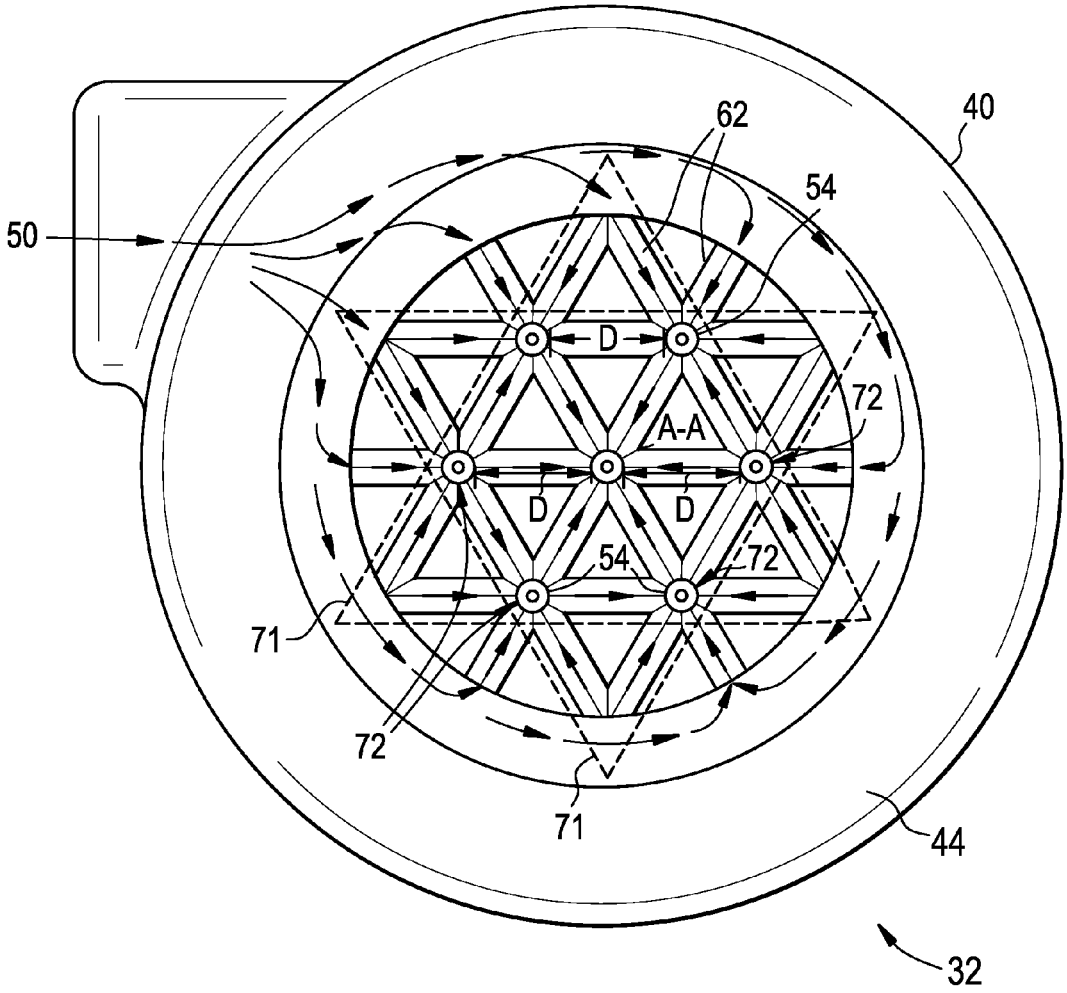
FIG. 4 is a front view of the fuel injector shown in FIG. 2.

Referring to both of FIGS. 2 and 4, a plurality of vanes 62 are located within the injector body 40. The vanes 62 are used to orient the air 56 entering the injector body 40. Specifically, the vanes 62 guide the air 56 in a direction that is generally parallel with a longitudinal axis A-A of the injector body 40. The fuel pegs 54 are arranged within the vanes 62. Specifically, the fuel 50 flows into the openings 52, where the openings 52 are fluidly connected to the vanes 62. The fuel 50 flows through the vanes 62 and into the fuel pegs 54, where the vanes 62 are fluidly connected to the fuel pegs 54.

It should be noted that while FIGS. 2-5 illustrate the secondary injector 32 having the vane 62 and fuel peg 54 configuration, it is to be understand that the vane and fuel peg arrangement illustrated may also be employed in the primary fuel injector 26 (shown in FIG. 1) as well. Moreover, it is also to be understood that while FIG. 1 illustrates the combustor 10 for a gas turbine, the injector illustrated in FIGS. 2-5 could be employed in a variety of different applications as well.

Figure 3:
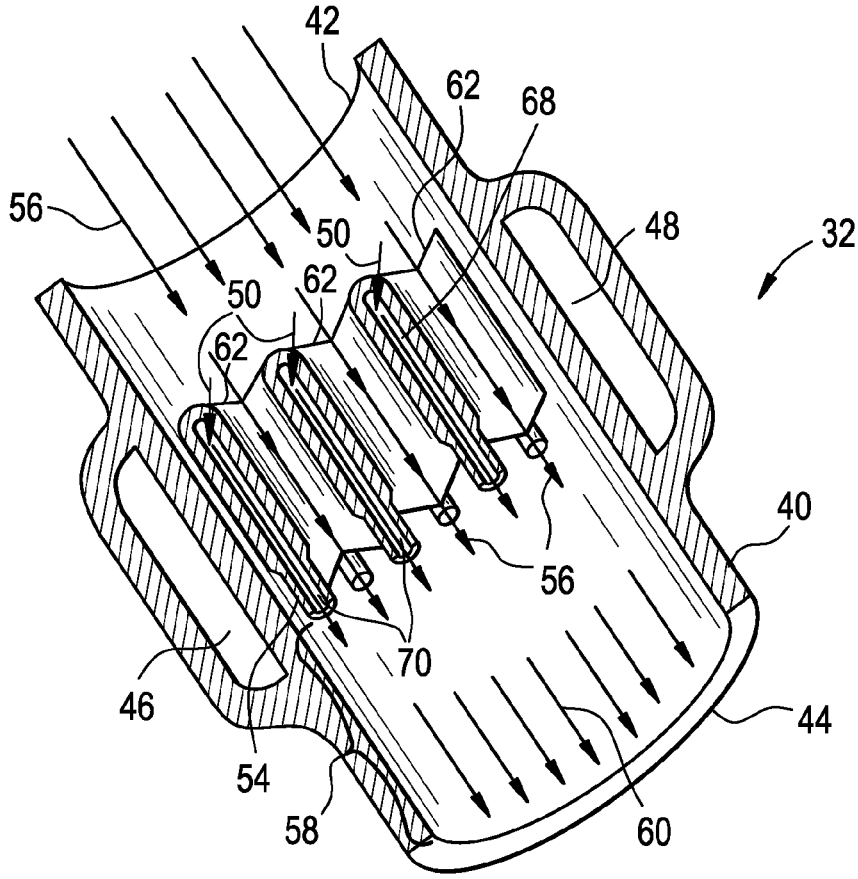
FIG. 3 is another cross-sectioned view of the fuel injector shown in FIG. 2.

Turning now to FIG. 3, a sectional view of the secondary injector 32 is shown, illustrating a cross-sectioned view of a portion of the fuel pegs 54 and the manifold 46. FIG. 3 also illustrates the fuel 50 flowing inside of the fuel pegs 54. Referring to both FIGS. 3-4, the fuel 50 travels through the vanes 62 and into a passageway 68 of each of fuel peg 54. The fuel 50 then exits the fuel pegs 54. Specifically, each of the fuel pegs 54 include an opening 70, where the fuel 50 flows through the openings 70 located in the fuel pegs 54. The fuel pegs 54 are employed to disperse the fuel 50 within the secondary injector 32.

FIG. 4 is an illustration of the secondary fuel injector 32 viewed along the outlet 44. As shown in FIG. 4, the fuel pegs 54 are each spaced at a distance D. The distance D is about equal between each of the fuel pegs 54. That is, the fuel pegs 54 are each spaced at about the same distance D from one another. In the exemplary embodiment as shown, the vanes 62 are arranged in a hexagram configuration. That is, the vanes 62 form a six-pointed geometric star figure that is the compound of two equilateral triangles 71 that are indicated by a phantom line. The fuel pegs 54 are disposed at vertices 72. The vertices 72 represent where the two equilateral triangles 71 intersect with one another. The intersection between the two equilateral triangles 71 creates a hexagon pattern. A fuel peg 54 is also disposed along the center axis A-A of the fuel injector body 40 as well. Referring now to both FIGS. 2 and 4, the air 56 flowing through the vanes 62 and the fuel 50 flowing out of the fuel pegs 54 mix with one another to create the air-fuel mixture 60 which exits the outlet 44 of the secondary injector 32.

Referring generally to FIGS. 1-4, the vanes 62 and fuel pegs 54 are arranged such that the fuel 50 and the air 56 are guided and mixed in the secondary injector body 32 to provide a generally heterogeneous mixture of fuel 50 in the air-fuel mixture 60 when compared to some other types of fuel injectors that are currently available. That is, the spacing the fuel pegs 54 and the length of the mixing zone 58 are arranged such that the fuel 50 and the air 56 partially premix. Specifically, the fuel 50 and the air 56 partially premix such that the fuel 50 from one of the fuel pegs 54 does not generally mix with the fuel 50 from another fuel peg 54 until after the air-fuel mixture 60 ignites upon mixing with the oncoming main flow 36.

Figure 5:
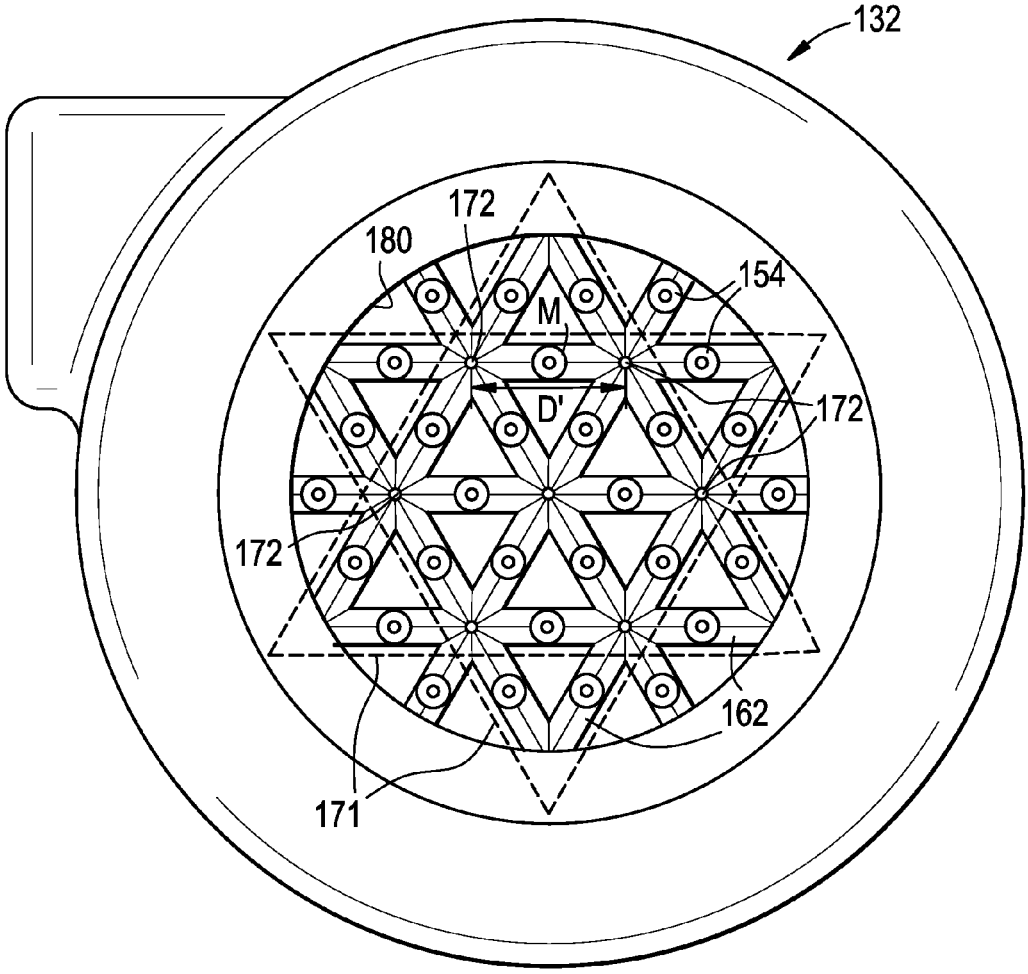
FIG. 5 is a front view of an alternative embodiment of the fuel injector shown in FIG. 2.

It should be noted that the fuel pegs 54 may be arranged within the fuel vanes 62 in a variety of different configurations. For example, FIG. 5 is an alternative embodiment of a secondary fuel injector 132 having fuel vanes 162 and fuel pegs 154. In the embodiment as shown in FIG. 5, the fuel pegs 154 are each spaced at a distance D'. The distance D' is about equal between each of the fuel pegs 154. Similar to FIG. 4, the vanes 162 are also arranged in a hexagram configuration. A portion of the fuel pegs 154 are disposed at a midpoint M that is located between two of the vertices 172. The vertices 172 represent where two triangles 171 intersect with one another. The remaining fuel pegs 154 that are not positioned between two of the vertices 172 are positioned between one of the vertices 172 and an inner wall 180 of the secondary fuel injector 132.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fuel injector, comprising:

an injector body including a manifold and an inlet, the manifold configured for receiving fuel and the inlet configured for receiving air;

a plurality of fuel vanes located within the injector body and positioned in a direction that is generally parallel with a longitudinal axis of the injector body to orient the air flowing from the inlet, the plurality of fuel vanes fluidly connected to the manifold and to one another to create a hexagram configuration; and a plurality of fuel pegs fluidly connected to and arranged within the plurality of fuel vanes.

2. The fuel injector of claim 1, wherein the plurality of fuel pegs and the plurality of fuel vanes are oriented such that an air-fuel mixture is created before an outlet of the injector body.

3. The fuel injector of claim 1, wherein the hexagram configuration includes two equilateral triangles that intersect one another at a plurality of vertices, the plurality of vertices each being spaced at a distance that is about equal between adjacent ones of the plurality of vertices.

4. The fuel injector of claim 3, wherein each of the plurality of fuel pegs is positioned on a corresponding one of the plurality of vertices.

5. The fuel injector of claim 4, further comprising a fuel pegs positioned along a center axis of the injector body.

6. The fuel injector of claim 3, wherein a portion of the plurality of fuel pegs is positioned at a midpoint between two of the plurality of vertices.

7. The fuel injector of claim 6, wherein a remaining portion of the plurality of fuel pegs are positioned between one of the plurality of vertices and an inner wall of the injector body.

8. The fuel injector of claim 1, wherein the fuel injector is one of a primary fuel injector and a secondary fuel injector for a gas turbine.

9. A combustor for a gas turbine, comprising:

at least one primary fuel injector;

at least one secondary fuel injector that is disposed downstream of the at least one primary fuel injector, the at least one secondary fuel injector comprising:

an injector body including a manifold, an inlet, and an outlet, the manifold configured for receiving fuel and the inlet configured for receiving air;

a plurality of fuel vanes located within the injector body and positioned in a direction that is generally parallel with a longitudinal axis of the injector body to orient the air flowing from the inlet, the plurality of fuel vanes fluidly connected to the manifold and to one another to create a hexagram configuration; and a plurality of fuel pegs fluidly connected to and arranged within the plurality of fuel vanes, the plurality of fuel pegs and the plurality of fuel vanes are oriented such that an air-fuel mixture is created before the outlet of the injector body.

10. The combustor of claim 9, wherein the hexagram configuration includes two equilateral triangles that intersect one another at a plurality of vertices, the plurality of vertices are each spaced at a distance that is about equal between adjacent ones of the plurality of vertices.

11. The combustor of claim 10, wherein each of the plurality of fuel pegs is positioned on a corresponding one of the plurality of vertices.

12. The combustor of claim 11, further comprising a fuel pegs positioned along a center axis of the injector body.

13. The combustor of claim 10, wherein a portion of the plurality of fuel pegs is positioned at a midpoint between two of the plurality of vertices.

14. The combustor of claim 13, wherein a remaining portion of the plurality of fuel pegs are positioned between one of the plurality of vertices and an inner wall of the injector body.

15. A combustor for a gas turbine, comprising:

at least one primary fuel injector and at least one secondary fuel injector that is disposed downstream of the at least one primary fuel injector, the at least one primary fuel injector comprising:

an injector body including a manifold, an inlet, and an outlet, the manifold configured for receiving fuel and the inlet configured for receiving air;

a plurality of fuel vanes located within the injector body and positioned in a direction that is generally parallel with a longitudinal axis of the injector body to orient the air flowing from the inlet, the plurality of fuel vanes fluidly connected to the manifold and to one another to create a hexagram configuration; and a plurality of fuel pegs fluidly connected to and arranged within the plurality of fuel vanes, and the plurality of fuel pegs and the plurality of fuel vanes are oriented such that an air-fuel mixture is created before the outlet of the injector body.

16. The combustor of claim 15, wherein the hexagram configuration includes two equilateral triangles that intersect one another at a plurality of vertices, the plurality of vertices are each spaced at a distance that is about equal between each of the plurality of vertices.

17. The combustor of claim 16, wherein each of the plurality of fuel pegs is positioned on a corresponding one of the plurality of vertices.

18. The combustor of claim 16, wherein a portion of the plurality of fuel pegs is positioned at a midpoint between two of the plurality of vertices.

* * * * *